US012535231B2

(12) United States Patent
Huang et al.

(10) Patent No.: US 12,535,231 B2
(45) Date of Patent: Jan. 27, 2026

(54) HUMIDIFIER

(71) Applicant: SHENZHEN CHENBEI TECHNOLOGY CO., LTD., Shenzhen (CN)

(72) Inventors: Yuzhong Huang, Shenzhen (CN); Xuequn Zhan, Shenzhen (CN)

(73) Assignee: SHENZHEN CHENBEI TECHNOLOGY CO., LTD., Shenzhen (CN)

( * ) Notice: Subject to any disclaimer, the term of this patent is extended or adjusted under 35 U.S.C. 154(b) by 320 days.

(21) Appl. No.: 18/374,988

(22) Filed: Sep. 29, 2023

(65) Prior Publication Data

US 2024/0110711 A1 Apr. 4, 2024

(51) Int. Cl.

| | |
|---|---|
| ***F24F 6/12*** | (2006.01) |
| ***F24F 1/037*** | (2019.01) |
| ***F24F 13/20*** | (2006.01) |
| *F24F 6/00* | (2006.01) |

(52) U.S. Cl.

CPC ..... *F24F 1/037* (2019.02); *F24F 6/12* (2013.01); *F24F 13/20* (2013.01); *F24F 2006/008* (2013.01)

(58) Field of Classification Search

CPC .... F24F 1/037; F24F 6/12; F24F 13/20; F24F 2006/008

USPC ..... 261/38

See application file for complete search history.

(56) References Cited

FOREIGN PATENT DOCUMENTS

CN 115031324 A * 9/2022
CN 217636106 U * 10/2022

OTHER PUBLICATIONS

English Machine Translation of CN 115031324 A (Year: 2022).*
English Machine Translation of CN 217636106 U (Year: 2022).*

* cited by examiner

*Primary Examiner* — Charles S Bushey
(74) *Attorney, Agent, or Firm* — Trojan Law Offices

(57) ABSTRACT

The present application belongs to the technical field of humidification devices which includes a detachably connected main unit and a water tank. An atomizing chamber is formed in the main unit, with a water inlet and an overflow port in the atomizing chamber. The atomizing chamber has a with a rim that surrounds the water inlet. Both the overflow port and the water inlet are connected to the water tank. A water stop valve is provided on the main unit which is used to close the overflow port when the main unit is detached from the water tank. Besides normal operation, the humidifier is capable of preventing the liquid to be atomized from dripping onto objects such as the ground or table after the main unit is detached from the water tank, thereby improving the user experience.

19 Claims, 7 Drawing Sheets

HUMIDIFIER

CROSS-REFERENCE TO RELATED APPLICATIONS

This Application claims priority to and benefit of the earlier Chinese Patent Application No. CN2 202222627545.8 filed on Sep. 30, 2022, the content of which is incorporated herein by reference in its entirety.

TECHNICAL FIELD

The present belongs to the technical field of humidification devices and in particular relates to a humidifier.

BACKGROUND

Following economic development and increased living standards, the demand for quality of life and good health has been increasingly high, and as a result, air humidifiers have gradually become a home appliance product that is indispensable to families in regions with dry climates.

The air humidifier comprises a water tank and a main unit. The main unit is usually detachably mounted on the water tank to facilitate cleaning and maintenance of the water tank and the main unit. However, during the removal of the main unit from the water tank, the liquid to be atomized in the atomizing chamber in the main unit often drips onto the ground or on the table, hindering the user experience.

BRIEF DESCRIPTION OF THE FIGURES

These and other features and advantages of the present disclosure will become appreciated, as the same becomes better understood with reference to the specification, claims and drawings herein.

SUMMARY OF THE INVENTION

Figure 1:
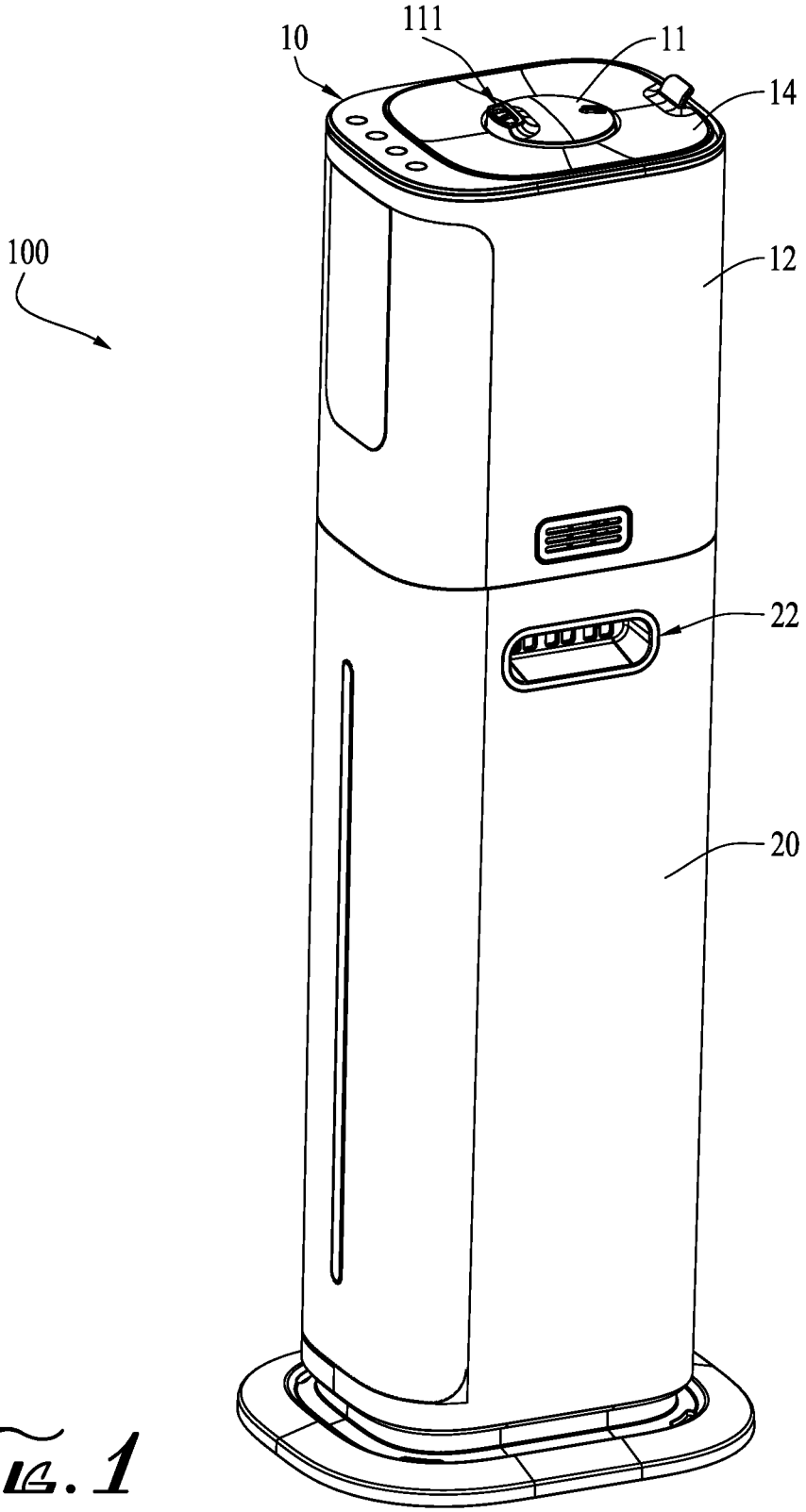
FIG. 1 is a structural schematic diagram of a humidifier provided by an embodiment of the present application.

The purpose of the present application is to provide a humidifier to solve the problem of liquid dripping onto the ground or on the table when the user detaches the main unit of a humidifier from the water tank.

In order to achieve the above, the technical solution adopted in the present application is: A humidifier comprising a detachably connected main unit and a water tank. An atomizing chamber is formed in the main unit, with a water filling opening and an overflow port in the atomizing chamber. Both the overflow port and the water filling opening are connected to the water tank, with a rim in the atomizing chamber surrounding the water inlet water filling opening. A valve is provided on the main unit which is used to close the overflow port when the main unit is detached from the water tank.

Optionally, the chamber bottom surface of the atomizing chamber is provided with a first convex platform, the water filling opening and the overflow port are formed on the surface of the first convex platform on the chamber bottom surface of the atomizing chamber, and the rim is provided on the surface of the first convex platform facing away from the chamber bottom surface of the atomizing chamber.

Optionally, the main unit has an air outlet, the air outlet is located in the atomizing chamber, the rim is formed with a liquid inlet connected to the water filling opening, and the air outlet is located above the liquid inlet.

Optionally, the height difference between the liquid inlet and the air outlet is in a range between 5 mm-30 mm.

Optionally, the height difference between the liquid inlet and the overflow port is in a range between 30.4 mm-38.6 mm.

Optionally, the main unit comprises an outer housing and an inner housing, the atomizing chamber is formed within the outer housing, and the valve is set on the outer housing;

The inner housing is located in the atomizing chamber, the inner housing is formed with a water filling chamber, and the inner housing is provided with a water filling tube. One end of the water filling tube is connected to the water filling chamber, while the other end of the water filling tube is inserted into the rim.

Optionally, a trigger is provided on the water tank for controlling the valve to close when the main unit is detached from the water tank.

Optionally, an overflow tube is formed within the main unit and one end of the overflow tube is connected to the overflow port; the valve is located at the other end of the overflow tube;

The valve comprises a seal and a drive assembly and the trigger is arranged in conjunction with the drive assembly and is capable of controlling the drive assembly to drive the movement of the seal to seal the overflow tube when the main unit is detached from the water tank.

Optionally, a handle is provided on the water tank and the handle is integrally formed with the trigger.

Optionally, the handle is provided with a water drainage hole for water flow into the water tank from the water filling opening.

One or more of the above technical solutions in the humidifier provided by the present application have at least one of the following technical effects: The atomizing chamber of the humidifier is provided with a rim that surrounds a water filling opening. A valve is provided on the main unit which closes the overflow port when the main unit is detached from the water tank. When the main unit is mounted on the water tank, the liquid to be atomized overflowing from the overflow port in the atomizing chamber can flow from the overflow port into the water tank to ensure the normal atomization of the main unit.

After the main unit is detached from the water tank, on the one hand, the liquid to be atomized in the atomizing chamber does not flow easily from the water filling opening to the outside of the main unit when it is shaken or tilted by the shaking or tilting of the main unit because it is blocked by the rim. After the main unit is detached from the water tank, the valve closes the overflow port so that the liquid to be atomized in the atomizing chamber cannot flow to the outside of the main unit from the overflow port. Therefore, while ensuring the normal operation of the humidifier, after the main unit is detached from the water tank, the liquid to be atomized in the atomizing chamber will not drip onto objects such as the ground or the table, thereby improving the user experience.

DETAILED DESCRIPTION

The present invention will be described with reference to the accompanying drawings, in which exemplary embodiments of the present invention are shown. It is noted that, in the accompanying drawings, the same components are denoted by the same reference numerals as possible. In addition, detailed descriptions of well-known functions and configurations that may obscure the subject matter of the present invention will be omitted.

In the descriptions of the present application, it is to be understood that the orientation or location relationships indicated by the terms "length," "width," "upper," "lower," "front," "rear," "left," "right," "vertical," "horizontal," "top," "bottom," "inner," "outer," etc. are based on the orientation or location relationships shown in the drawings.

They are merely for the purpose of describing the present application and simplifying the descriptions and are not intended to indicate or imply that the device or element referred to must have a particular orientation or be constructed and operated in a particular orientation, and thus cannot be construed as limitations of the present application.

Furthermore, the terms "first" and "second" are used for descriptive purposes only and are not to be construed as indicating or implying relative importance or implicitly indicating the number of technical features indicated. As such, features defined as "first" and "second" may explicitly or implicitly include one or more of the features. In the descriptions of the present application, "multiple" means two or more, unless specifically defined otherwise.

In the present application, unless otherwise expressly stipulated and defined, the terms "mounting," "connected," "connection," "fixed," and other terms should be understood in a broad sense. For example, they can be fixed connections, detachable connections, or integrated; they can be mechanical connections or electrical connections; they can be directly connected or indirectly connected through intermediate media, and they can be the connection between two elements or the interaction between two elements. For those of ordinary skill in the art, the specific meaning of the above terms in the present application may be understood on a case-by-case basis.

In the description of the present application, it is worth noting that the term "and/or" is simply an association that describes associated objects, meaning that there may be three relationships, e.g., A and/or B, which may mean: A alone, A and B, and B alone. It is worth noting that the same reference numerals represent the same component part or the same part in the embodiments of the present application, and for the same parts in the embodiments of the present application, reference numerals may only be marked with one part or component as an example. It should be understood that for other identical parts or components, the reference numerals also apply.

In the present application, the terms "one embodiment," "some embodiments," "examples," "specific examples," or "some examples," etc. mean that specific features, structures, materials, or characteristics described in connection with the embodiment or example are included in at least one embodiment or example of the present application. In the present Specification, schematic representations of the above-described terms are not necessarily directed at the same embodiment or example. Moreover, the specific features, structures, materials, or characteristics described may be combined in a suitable manner in any one or more embodiments or examples. Further, as long as there is no contradiction, one skilled in the art may combine and assemble features of different embodiments or examples described in the present Specification.

A humidifier comprises a water tank and a main unit, which can be detached to facilitate cleaning, maintenance, and other operations of the water tank and main unit. The main unit is usually provided with an atomizing chamber. The atomizing chamber stores the liquid to be atomized. The present inventor(s) have noticed that during the removal of the main unit from the water tank, the main unit will shake or tilt, causing the liquid to be atomized to shake and tilt accordingly, thereby flowing from the overflow port and water filling opening in the atomizing chamber to the outside of the main unit and then dripping onto the ground or table, causing contamination and requiring the user to clean it up, thereby greatly hindering the user experience. Wherein, it is worth noting that the degree of shake or tilt of the main unit due to the limitation of structural space, adjustment of use, and operating habits after detachment of the main unit from the water tank is limited and controllable.

In order to alleviate the above problems, the inventor(s) have engaged in extensive research and designed a humidifier, with a rim around the water filling opening and a valve on the main unit, which can close the overflow port when the main unit is detached from the water tank. In this way, after the main unit is detached from the water tank, the valve closes the overflow port. In this way, when the main unit shakes or tilts, the liquid to be atomized in the atomizing chamber will not overflow from the overflow port. At the same time, the rim can block the liquid to be atomized so that the liquid to be atomized cannot flow out of the water filling opening, and as a result, there will be no problem of the liquid to be atomized dripping after the main unit is detached from the water tank, thereby greatly improving the user experience. Wherein, the humidifier can be a tower humidifier, a desktop humidifier, a portable humidifier, etc. The liquid to be atomized includes, but is not limited to water, an essential oil solution, or a drug solution, to achieve the effects such as humidifying air or treating diseases.

For ease of description, embodiments of the present application are illustrated with a tower humidifier as an example.

In one embodiment of the present application, with reference to FIG. 1, a humidifier 100 is provided, including a detachably connected main unit 10 and water tank 20. It can be understood that the main unit 10 can atomize liquid into an atomized vapor and discharge it into air, while the water tank 20 is used to store the liquid to be atomized and to provide the main unit with the liquid to be atomized, making the use of the humidifier 100 more convenient. Specifically, the connection between the main unit 10 and the water tank 20 can be made by detachable means such as screwing, snapping, etc. to realize the separation of the main unit 10 and the water tank 20, thereby facilitating the cleaning, maintenance, and other operations of the water tank 20 and the main unit 10. In this embodiment, with reference to FIG. 2, an atomizing chamber 1201 is formed in the main unit 10. It can be understood that the atomizing chamber 1201 is used to store the liquid to be atomized and to provide space for atomization of the liquid to be atomized into atomized vapor; wherein, it is worth noting that a pump, an atomizing device, and a fan are provided in the main unit 10. The pump draws the liquid to be atomized stored in the water tank 20 into the atomizing chamber 1201. After the atomizing device atomizes the liquid to be atomized in the atomizing chamber 1201, the atomized vapor is discharged out of the main unit 10 through the fan so as to achieve atomizing operation. The atomizing device is any device such as an atomizer plate that can atomize liquid to be atomized into atomized vapor. Its specific type can be selected according to actual needs and is not defined here.

Figure 3:
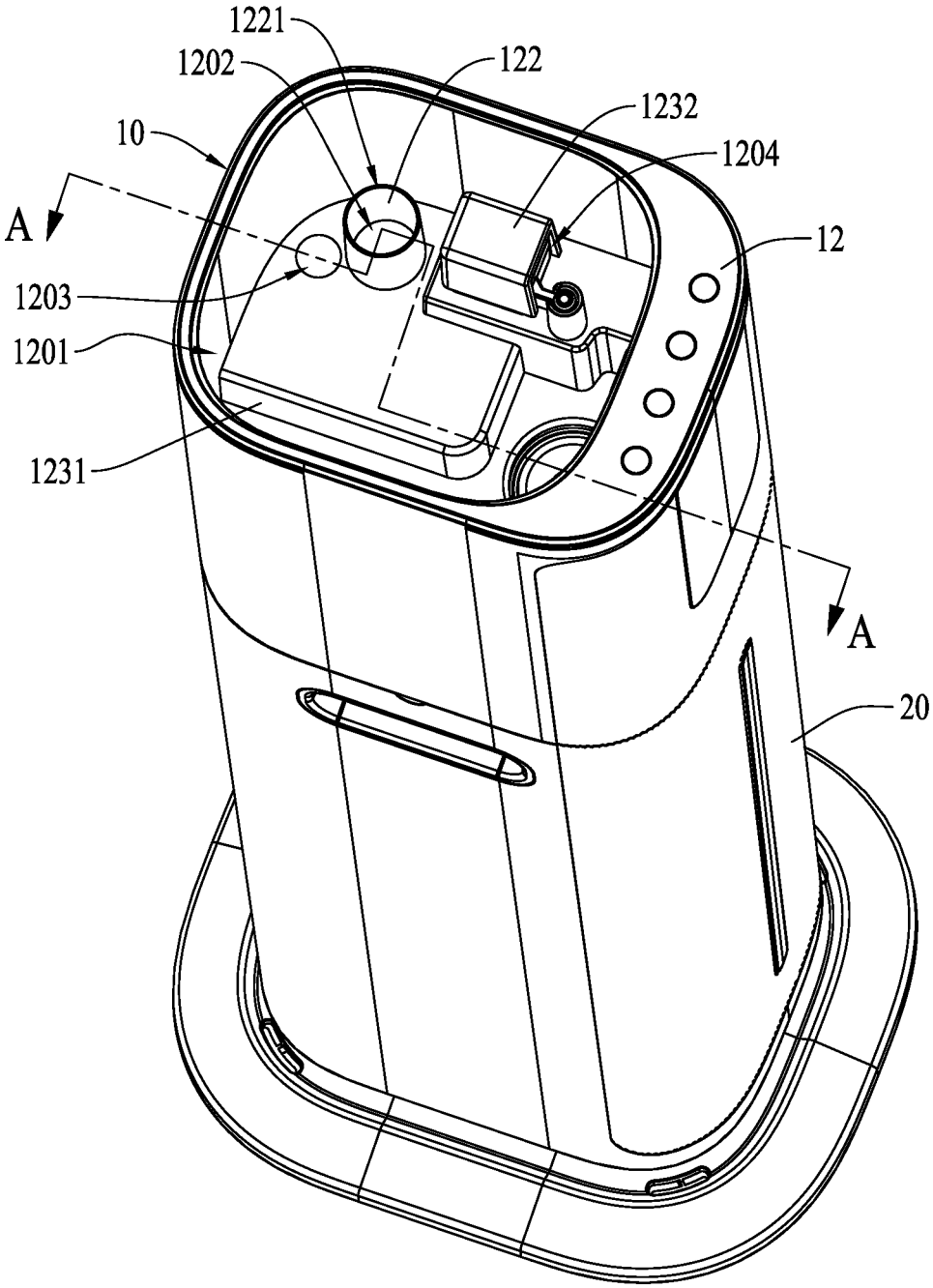
FIG. 3 is a schematic diagram of the structure behind the concealed inner housing, top cover, and defogging cover of the humidifier shown in FIG. 2.

In this embodiment, with reference to FIG. 3, the atomizing chamber 1201 is provided with a water filling opening 1202 and an overflow port 1203, and the overflow port 1203 and a water filling opening 1202 are both connected to the water tank 20. It can be understood that the liquid to be atomized can enter the water tank 20 from the water filling opening 1202 to realize the liquid filling of the water tank 20. The liquid filling operation does not require disassembly of the main unit 10 and the water tank 20 and is simple and fast; the overflow port 1203 can discharge the liquid to be atomized overflowing from the overflow port 1203 in the atomizing chamber 1201 into the water tank 20. On the one hand, this can ensure that the atomizing chamber 1201 stores a preset volume of liquid to be atomized and that the atomizing device can work normally so that the main unit 10 has good atomization performance; on the other hand, the liquid to be atomized that overflows from the overflow port 1203 in the atomizing chamber 1201 directly flows into the water tank 20 for recovery, which can also realize the recycling of the liquid to be atomized; wherein, the position of the overflow port 1203 can be set according to the preset volume and the preset volume can be designed according to the atomizing device. For example: The preset volume may be determined according to the maximum working water level, etc. of the atomizing device and is not defined here.

In this embodiment, with reference to FIG. 3, the atomizing chamber 1201 is provided with a rim 122, and the rim 122 surrounds the water filling opening 1202; it can be understood that the water filling opening 1202 is provided with a rim 122. The rim 122 is hollow and cylindrical and the water filling opening is located within the rim 122. When the main unit 10 shakes or tilts, the rim 122 can separate the liquid to be atomized in the atomizing chamber 1201 from the water filling opening 1202 so that the liquid to be atomized in the atomizing chamber 1201 does not flow easily into the rim 122, and furthermore, does not enter the water filling opening 1202 easily, thereby preventing the liquid to be atomized in the atomizing chamber 1201 from flowing from the water filling opening to drip outside the main unit 10; the upper end surface of the rim 122 is located above the overflow port 1203, thereby ensuring the normal overflow function of the overflow port 1203.

Figure 4:
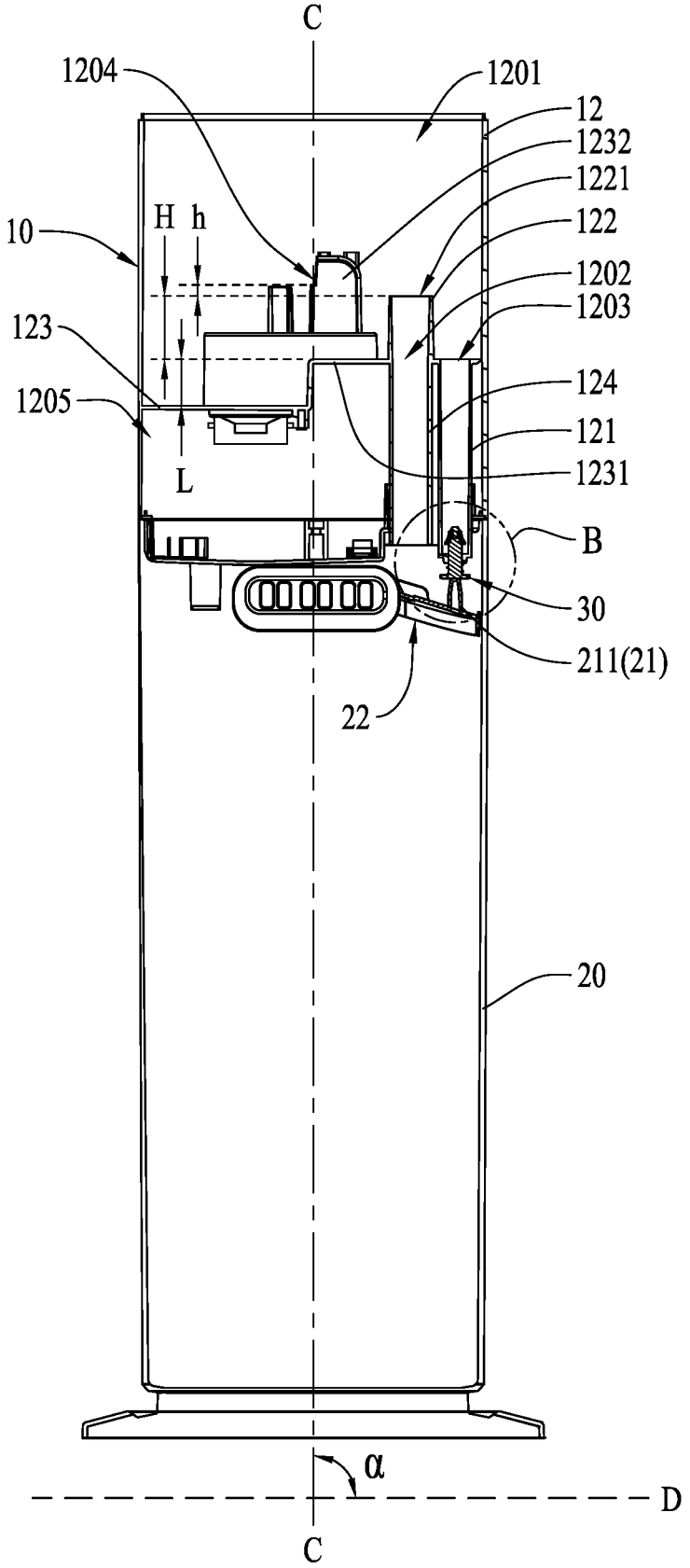
FIG. 4 is a cutaway view along the A-A line in FIG. 3.

In the present embodiment, with reference to FIG. 4, a valve 30 is provided on the main unit 10; the valve 30 is used to close the overflow port 1203 when the main unit 10 is detached from the water tank 20. It can be understood that the valve 30 can open and close the overflow port 1203. When the overflow port 1203 is in the open state, the liquid to be atomized overflowing from the overflow port 1203 in the atomizing chamber 1201 can flow from the overflow port 1203 to the water tank 20; when the overflow port 1203 is in the closed state, the liquid to be atomized in the atomizing chamber 1201 cannot flow from the overflow port 1203 into the water tank 20 or flow to the outside of the main unit 10; when the main unit 10 is detached from the water tank 20, the valve 30 can close the overflow port 1203, putting the overflow port 1203 in the closed state. At this time, the liquid to be atomized in the atomizing chamber 1201 cannot flow from the overflow port 1203 to the outside of the main unit 10 and will not drip onto objects such as the ground or table; after the main unit 10 is mounted on the water tank 20, the valve 30 can open the overflow port 1203; that is, put the overflow port 1203 in the open state. At this time, the [liquid] to be atomized overflowing from the overflow port 1203 in the atomizing chamber 1201 can overflow from the overflow port 1203 and then flow into the water tank 20 to ensure that the atomizing device can work normally so that the main unit 10 has good atomization performance. Wherein, the valve 30 may be a spring valve, an electromagnetic valve, etc.

In humidifier 100 of the embodiment of the present application, atomizing chamber 1201 is provided with a rim 122, and the rim 122 surrounds the water filling opening 1202.

A valve 30 is provided on the main unit 10; the valve 30 is used to close the overflow port 1203 when the main unit 10 is detached from the water tank 20; after the main unit 10 is mounted on the water tank 20, the liquid to be atomized overflowing from the overflow port 1203 in the atomizing chamber 1201 can flow from the overflow port 1203 into the water tank 20 to ensure the normal atomization of the main unit 10; after the main unit 10 is detached from the water tank 20, on the one hand, the liquid to be atomized in the atomizing chamber 1201 does not flow easily from the water filling opening 1202 to the outside of the main unit 10 when it is shaken or tilted by the shaking or tilting of the main unit 10 because it is blocked by the rim 122; on the other hand, after the main unit 10 is detached from the water tank 20, the valve 30 closes the overflow port 1203 so that the liquid to be atomized in the atomizing chamber 1201 cannot flow to the outside of the main unit 10 from the overflow port 1203; therefore, while ensuring the normal operation of the humidifier 100, after the main unit 10 is detached from the water tank 20, the liquid to be atomized in the atomizing chamber 1201 will not drip onto objects such as the ground or the table, thereby improving the user experience.

In another embodiment of the present application, with reference to FIGS. 3 and 4, the chamber bottom surface of the atomizing chamber 1201 of the humidifier 100 provided is provided with a first convex platform 1231, the water filling opening 1202 and the overflow port 1203 are formed on the surface of the first convex platform 1231 facing away from the chamber bottom surface of the atomizing chamber 1201, and the rim 122 is provided on the surface of the first convex platform 1231 facing away from the chamber bottom surface of the atomizing chamber 1201. Specifically, the first convex platform 1231 is arranged so that the overflow port 1203 and the water filling opening 1202 are higher than the chamber bottom surface of the atomizing chamber 1201. In this way, the liquid surface of the liquid to be atomized stored in the atomizing chamber 1201 is lower than the overflow port 1203 and the water filling opening 1202 or flush with the overflow port 1203 and the water filling opening 1202 so that the atomizing chamber 1201 can store a preset volume of liquid to be atomized to ensure normal use of the atomizing device; in addition, a rim 122 surrounds the water filling opening 1202, so that when the main unit 10 is tilted, the liquid to be atomized does not flow easily from the water filling opening 1202 to the outside of the main unit 10 and drip onto objects such as the ground or table, thereby improving the user experience; the structure is simple and convenient to process.

When the main unit 10 is detached from the water tank 20 as shown in FIG. 4, due to structural space limitations, the typical tilt angle of the main unit 10 is usually between 20° and 30°; whereas during normal use of the humidifier 100, the tilt angle may not be greater than 25°. Thus, 25° is usually used as the design angle during the design of the humidifier 100; wherein, the tilt angle refers to the complementary angle of the included angle $\alpha$ between the axis C-C of the main unit and the horizontal plane D.

In another embodiment of the present application, with reference to FIGS. 3 and 4, the main unit 10 of the humidifier 100 is provided with an air outlet 1204, which is located in the atomizing chamber 1201. The rim 122 forms a liquid inlet 1221 connected to the water filling opening 1202 and the air outlet 1204 is located above the liquid inlet 1221. It can be understood that the liquid inlet 1221 can allow the liquid to be atomized to flow into the rim 122, thereby flowing into the water tank 20 from the water filling opening 1202 or to the outside of the main unit 10; specifically, when there is no opening on the peripheral wall of the rim 122, the liquid inlet 1221 refers to an opening formed surrounding the upper end surface of the rim 122; when there is an opening on the peripheral wall of the rim 122, the liquid inlet 1221 is the opening at the lowest position; in addition, the air outlet 1204 is located above the liquid inlet 1221. In this way, when the tilt angle of the main unit 10 is relatively large, the liquid to be atomized can flow out from the liquid inlet 1221 so that it will not enter the main unit 10 from the air outlet 1204, ensuring the safety of the electronic components (such as fans, circuit boards, etc.) inside the main unit 10.

In a specific embodiment, with reference to FIGS. 3 and 4, a second convex platform 1232 is provided on the chamber bottom surface of the atomizing chamber 1201 and an air outlet 1204 is formed on the end of the second convex platform 1232 facing away from the chamber bottom surface of the atomizing chamber 1201, facilitating the setting of the air outlet 1204. The water filling opening 1202 and the overflow port 1203 are set at intervals. The water filling opening 1202 is located between the second convex platform 1232 and the overflow port 1203. The air outlet 1204 is set at the side of the second convex platform 1232 facing away from the rim 122. In this way, when the main unit 10 is tilted towards the air outlet 1204, the liquid to be atomized will accumulate on the side of the air outlet.

At this time, the air outlet 1204 is located above the liquid surface of the liquid to be atomized and set opposite to the liquid surface with the liquid to be atomized. At this time, the liquid to be atomized does not easily enter the main unit 10 from the air outlet 1204, ensuring the safety of the internal components (such as fans, circuit boards, etc.) of the main unit 10; in addition, when the main unit 10 is tilted toward the overflow port 1203, the liquid to be atomized will accumulate at the overflow port 1203, and the air outlet 1204 is likely to be exposed above the liquid surface of the liquid to be atomized. At this time, the liquid to be atomized does not easily enter the main unit 10 from the air outlet 1204, ensuring the safety of the internal components (such as fans, circuit boards, etc.) of the main unit 10.

In another specific embodiment, with reference to FIG. 3, the second convex platform 1232 may be a multi-step structure or a single-step structure, which may be selected according to actual needs.

In another embodiment of the present application, with reference to FIG. 4, the value of the height difference h between the liquid inlet 1221 and the air outlet 1204 of the provided humidifier 100 ranges from 5 mm to 30 mm. Therefore, it can be ensured that when the main unit 10 is tilted at a relatively large angle, the liquid to be atomized in the atomizing chamber 1201 flows out of the overflow port 1203 or the liquid inlet 1221 without entering the interior of the main unit 10, ensuring the safety of the components (such as fans, circuit boards, etc.) inside the main unit 10. It can also take into account the height of the main unit 10; if the height difference is set too small, when the main unit 10 is tilted, the liquid to be atomized can easily enter the interior of the main unit 10 from the air outlet 1204, resulting in damage to the main unit 10; if the height difference is set too large, the overall volume of the main unit 10 will be too large, affecting the appearance and layout of the humidifier 100. Wherein, the value of the height difference h can be 5 mm, 5.5 mm, 6 mm, 6.5 mm, 7 mm, 7.5 mm, 8 mm, 8.5 mm, 9 mm, 9.5 mm or 10 mm, 10.5 mm, 11 mm, 11.5 mm, 12 mm, 12.5 mm, 13 mm, 13.5 mm, 14 mm, 14.5 mm, 15 mm, 15.5 mm, 16 mm, 16.5 mm, 17 mm, 17.5 mm, 18 mm, 18.5 mm, 19 mm, 19.5 mm, 20 mm, 20.5 mm, 21 mm, 21.5 mm, 22 mm, 22.5 mm, 23 mm, 23.5 mm, 24 mm, 24.5 mm, 25 mm, 25.5 mm, 26 mm, 26.5 mm, 27 mm, 27.5 mm, 28 mm, 28.5 mm, 29 mm, 29.5 mm, or 30 mm.

In a specific embodiment, when the value of the height difference h between the liquid inlet 1221 and the air outlet 1204 is 5 mm and the tilt angle of the main unit 10 reaches 32°, the liquid to be atomized will not enter the interior of the main unit 10 from the air outlet 1204. Compared with the design angle, there is a 30% safety margin for the height difference h; that is, when the value of the height difference h is greater than or equal to 5 mm, the safety usage requirements of the main unit 10 can be met. Preferably, the height difference h is 6 mm.

In another embodiment of the present application, with reference to FIG. 4, the value of the height difference H between the liquid inlet 1221 and the overflow port 1203 of the provided humidifier 100 ranges from 30.4 mm to 38.6 mm. This setting ensures that the liquid to be atomized will not flow out of the water filling opening 1202; however, if the height difference H is set too small, the liquid to be atomized will flow out of the water filling opening 1202, thereby dripping onto objects such as the ground or table; if the height difference H is set too large, it will increase the volume of the entire main unit 10, resulting in material waste, which is not conducive to the miniaturization and portability of the humidifier 100. Specifically, the value of the height difference H may be 30.4 mm, 30.6 mm, 30.8 mm, 31 mm, 31.2 mm, 31.4 mm, 31.6 mm, 31.8 mm, 32 mm, 32.2 mm, 32.4 mm, 32.6 mm, 32.8 mm, 33 mm, 33.2 mm, 33.4 mm, 33.6 mm, 33.8 mm, 34 mm, 34.2 mm, 34.4 mm, 34.6 mm, 34.8 mm, 35 mm, 35.2 mm, 35.4 mm, 35.6 mm, 35.8 mm, 36 mm, 36.2 mm, 36.4 mm, 36.6 mm, 36.8 mm, 37 mm, 37.2 mm, 37.4 mm, 37.6 mm, 37.8 mm, 38 mm, 38.2 mm, 38.4 mm, or 38.6 mm.

In a specific embodiment, when the main unit 10 is detached from the water tank 20, the tilt angle of the main unit 10 is set at 25°, the highest water level L of the atomizing device is 40 mm, and the corresponding height H of the rim 122 is 34.3 mm, which can ensure that the liquid to be atomized will not flow out of the water filling opening 1202; at the same time, if the height difference h between the water filling opening 1221 and the air outlet 1204 is 6 mm, when the tilt angle of the main unit 10 is relatively large, the liquid to be atomized can flow out of the water filling opening 1202 without entering the interior of the main unit 10 from the air outlet 1204.

Figure 2:
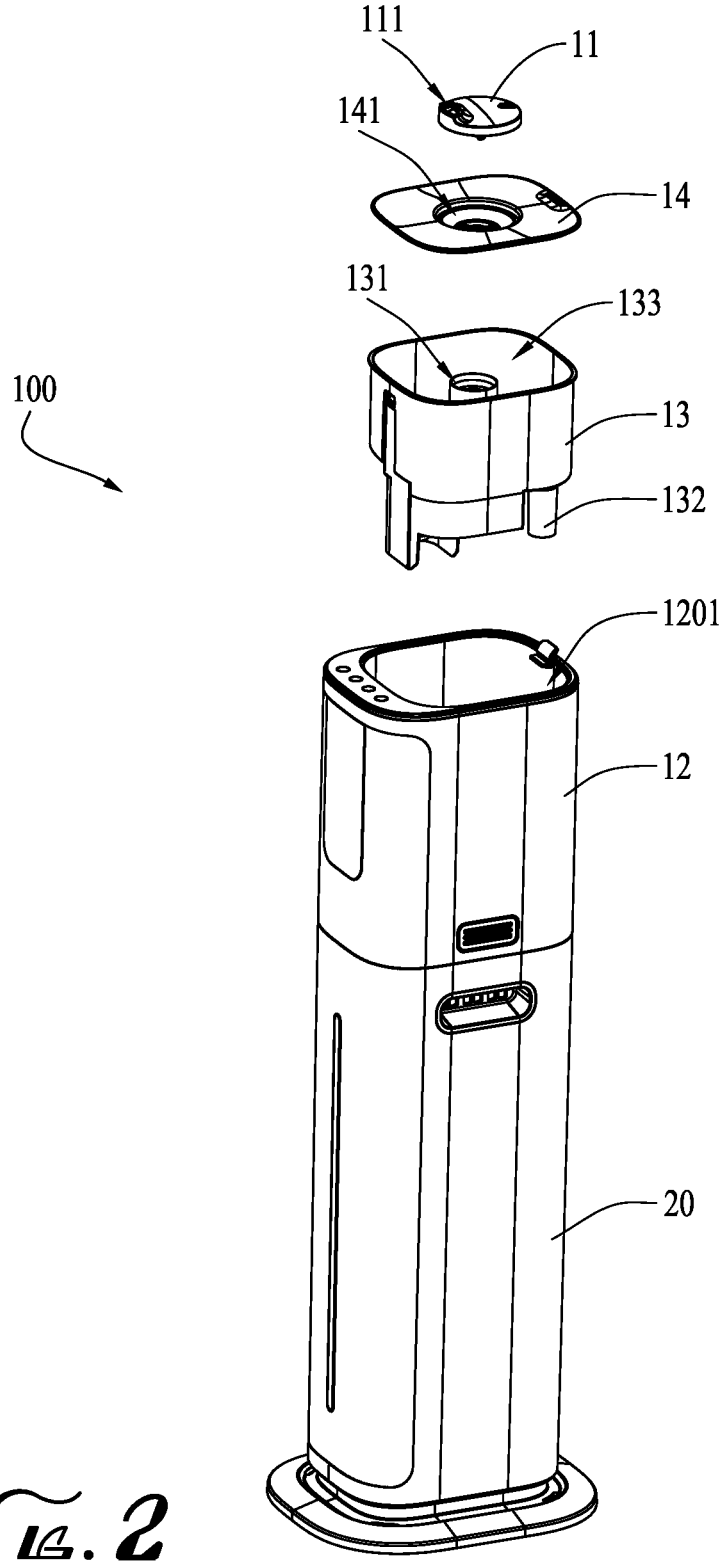
FIG. 2 is an exploded-view diagram of the humidifier shown in FIG. 1.

In another embodiment of the present application, with reference to FIGS. 1, 2, and 3, the main unit 10 of the provided humidifier 100 comprises an outer housing 12 and an inner housing 13. An atomizing chamber 1201 is formed in the outer housing 12 and a valve 30 is provided on the outer housing 12; the inner housing 13 is located in the atomizing chamber 1201. The inner housing 13 is formed with a water filling chamber 133. The inner housing 13 is provided with a water filling tube 132. One end of the water filling tube 132 is connected to the water filling chamber 133 and the other end of the water filling tube 132 is inserted into the rim 122. Specifically, during the filling operation, the liquid to be atomized is poured into the water filling chamber 133 and the liquid to be atomized can flow directly into the water tank 20 through the water filling tube 132. The space of the water filling chamber 133 is large. The backflow operation of the liquid to be atomized is simple and fast and the filling operation of the liquid to be atomized is simple and fast; in addition, the water filling tube 132 is inserted into the overflow tube 121 so that the liquid to be atomized can enter the water tank 20 smoothly, improving the efficiency of filling; additionally, the liquid to be atomized does not drain easily into the atomizing chamber 1201 from the connection between the water filling tube 132 and the rim 122.

Wherein, it is worth noting that with reference to FIGS. 1, 2, and 3, the main unit 10 further comprises a top cover 14 and a mist outlet cover 11. The inner housing 13 nests within the atomization chamber 1201. The top cover 14 is provided at the opening of the atomizing chamber 1201 and seals the opening of the water filling chamber 133. A connecting hole 141 is provided on the top cover 14. The inner housing 13 is provided with a mist outlet channel 131. The mist outlet channel 131 connects the atomizing chamber 1201 and the connecting hole 141. A mist outlet cover 11 is provided in the connecting hole 141. The mist outlet cover 11 is formed with a mist outlet hole 111. After the atomized vapor generated by the atomizing device enters the mist outlet channel 131 under the blowing of the fan, it is discharged through the mist outlet hole 111, thus completing the defogging of the humidifier 100; in addition, under the guidance of the mist outlet channel 131, the atomized vapor does not diffuse into the water filling chamber 133, ensuring better defogging performance; specifically, a partition 123 is provided within the outer housing 12. The partition 123 divides the inner chamber of the outer housing 12 into a mounting chamber 1205 and an atomizing chamber 1201. The atomizing device, fan, and a water pump are all set within the mounting chamber 1205. The partition 123 protrudes towards the atomizing chamber 1201 to form a first convex platform 1231 and a second convex platform 1232. In this way, the first convex platform 1231 and the second convex platform 1232 face away from the side of the atomizing chamber 1201 to form a holding space to facilitate the mounting of the atomizing device, fan, and water pump; in addition, the air outlet of the fan is connected to the air outlet 1204 on the second convex platform 1232. The air blown by the fan enters the mist outlet channel 131 through the air outlet 1204 on the second convex platform 1232 to realize defogging.

Figure 5:
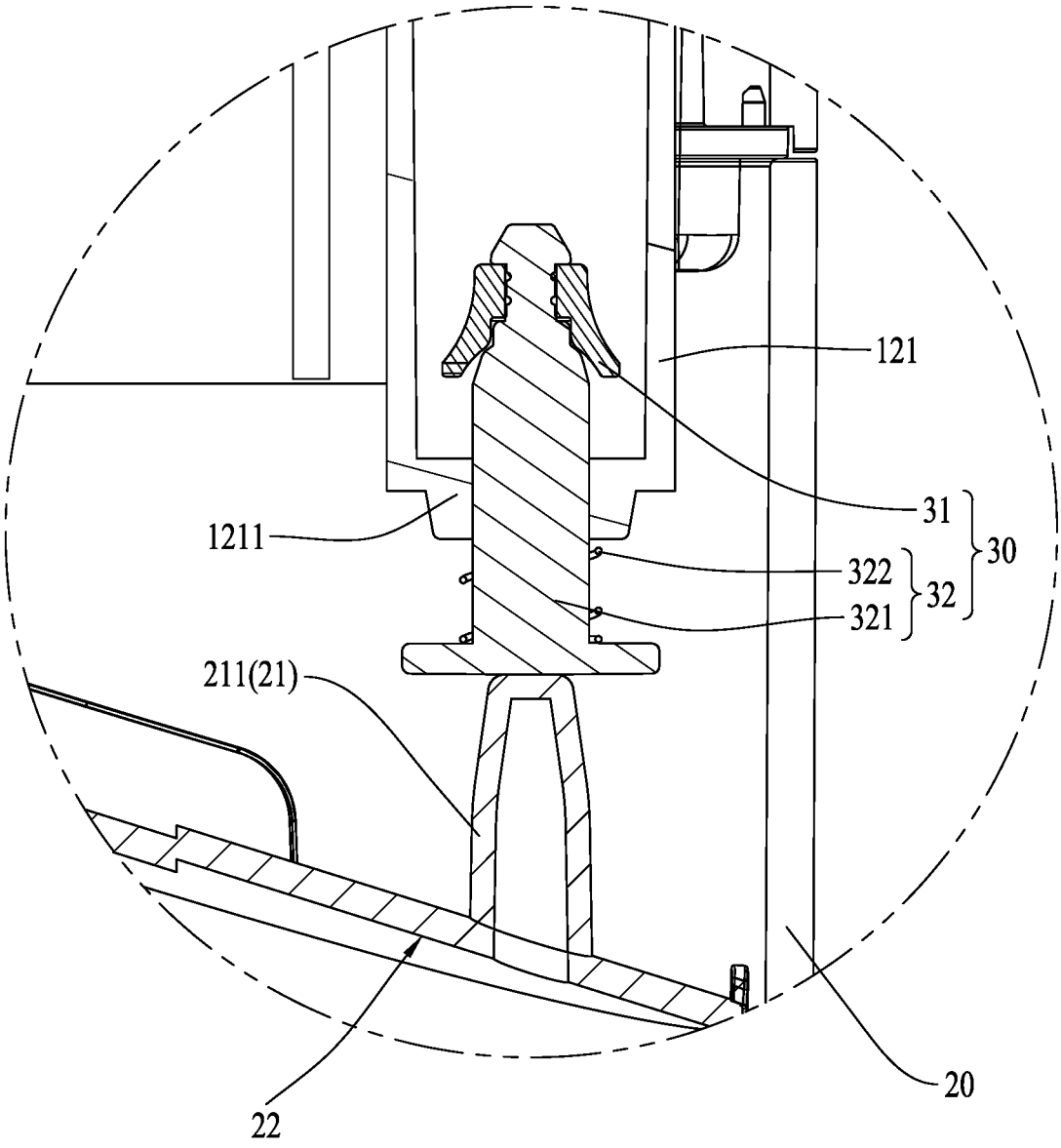
FIG. 5 is a partially enlarged view of B in FIG. 4.

In another embodiment of the present application, with reference to FIGS. 4 and 5, a trigger 21 is provided on the water tank 20 of the humidifier 100 for controlling the valve 30 to close when the main unit 10 is detached from the water tank 20. It can be understood that when the main unit 10 is detached from the water tank 20, the trigger 21 is separated from the main unit 10, thereby triggering the valve 30 to close, preventing the liquid to be atomized from flowing from the overflow port 1203; when the main unit 10 is mounted on the water tank 20, the trigger 21 causes the valve 30 to open, thereby ensuring the normal overflow function of the overflow port 1203.

In a specific application, when the main unit 10 is mounted on the water tank 20, the opening of the valve 30 can be realized automatically; after the main unit 10 is separated from the water tank 20, the closing of the valve 30 can also be realized automatically. The switching of the valve 30 is a simple operation.

In another embodiment of the present application, with reference to FIGS. 4 and 5, the main unit 10 of the humidifier 100 is provided with an overflow tube 121. One end of the overflow tube 121 is connected to the overflow port 1203; the valve 30 is located at the other end of the overflow tube 121; it can be understood that the overflow tube 121 can connect with the overflow port 1203 and the water tank 20. When the valve 30 is in the open state, the liquid to be atomized can flow from the overflow port 1203 through the overflow tube 121 to the water tank 20; when the valve 30 is in the closed state, the valve 30 blocks the overflow tube 121 so that the liquid to be atomized cannot flow to the outside of the main unit 10 from the overflow port 1203 through the overflow tube 121.

In the present embodiment, with reference to FIGS. 4 and 5, the valve 30 comprises a seal 31 and a drive assembly 32. A trigger 21 is provided in conjunction with the drive assembly 32 and is capable of triggering the drive assembly 32 to drive the seal 31 to move to seal the overflow tube 121 when the main unit 10 is detached from the water tank 20. Specifically, when the main unit 10 is detached from the water tank 20, the trigger 21 triggers the drive assembly 32 to drive and move the seal 31, thereby causing the seal 31 to block the overflow tube 121, preventing the liquid to be atomized from flowing to the outside of the main unit 10 from the overflow tube 121. This reduces the risk of dripping of the liquid to be atomized and improves the user experience; in addition, when the main unit 10 is mounted on the water tank 20, the trigger 21 triggers the drive assembly 32 to drive and move the seal 31, thereby unblocking the overflow tube 121 so that the overflow tube 121 is in an unobstructed state. At this time, the excess liquid to be atomized can flow into the water tank 20 from the overflow port 1203 through the overflow tube 121 so that the liquid to be atomized in the atomizing chamber 1201 is at a preset volume, ensuring that the atomizing device can work normally and guaranteeing atomization performance.

In a specific embodiment, an electromagnetic trigger structure, a photoelectric trigger structure, etc. may be adopted between the trigger 21 and the drive assembly 32, which can trigger the assembly 32 to move the seal between the trigger 21 and the drive 31 to achieve the blocking and opening of the overflow tube 121. The specific structures may be selected according to actual needs and are not defined here.

Wherein, it is worth noting that, with reference to FIGS. 4 and 5, the overflow tube 121 is provided on the outer housing 12 and the connecting tube 124 is also provided on the outer housing 12. The connecting tube 124 is connected to the water filling opening 1202 and the water tank 20 to ensure that the liquid to be atomized successfully enters the water tank 20 through the water filling opening 1202 and the connecting tube 124 to reduce the risk of drainage. Wherein, the overflow tube 121, connecting tube 124, and outer housing 12 can be made as an integrated structure through integrated injection molding or 3D integrated printing. This can provide savings on the production process and offers good structural strength, and help reduce production costs and improve the service life.

In another embodiment of the present application, with reference to FIGS. 4 and 5, the drive assembly 32 of the provided humidifier 100 further comprises a top rod 321 and a spring unit 322. The inner wall of the overflow tube 121 is provided with an annular projection 1211 extending circumferentially. The annular projection 1211 surrounds and forms a mounting hole; the top rod 321 is threaded within the mounting hole and is matched with the gap of the mounting hole. It can be understood that there is a gap between the outer peripheral wall of the top rod 321 and the inner wall of the mounting hole, enabling the connecting rod to move within the perforation. At the same time, the liquid to be atomized within the overflow tube 121 can flow into the water tank 20 through the gap between the outer peripheral wall of the top rod 321 and the inner wall of the mounting hole to realize recovery of the overflow of the excess liquid to be atomized, ensuring that the liquid to be atomized in the atomizing chamber 1201 is within the preset volume range and guaranteeing the normal operation of the atomizing device; the seal 31 is connected with the top rod 321 towards the end of the overflow port 1203. The radial dimensions of the seal 31 are smaller than the inner diameter of the overflow tube 121. It can be understood that the seal 31 is located within the overflow tube 121. The seal 31 is matched with the gap of the overflow tube 121. That is, there is a gap between the outer peripheral wall of the seal 31 and the inner peripheral wall of the overflow tube 121. This gap allows the liquid to be atomized to flow through before flowing into the water tank 20 through the gap between the outer peripheral wall of the top rod 321 and the inner wall of the mounting hole to realize recovery of the overflow of the excess liquid to be atomized, ensuring that the liquid to be atomized in the atomizing chamber 1201 is within the preset volume range and guaranteeing the normal operation of the atomizing device; specifically, the seal 31 may be fixedly sleeved at the end of the top rod 321 facing the overflow port 1203. The seal 31 can also be screwed to the end of the top rod 321 facing the overflow port 1203. Of course, in other embodiments, other connection methods can also be used, which can be selected according to actual needs and are not defined here.

In this embodiment, with reference to FIGS. 4 and 5, the spring unit 322 is set outside the end of the top rod 321 facing away from the overflow port 1203 so that the seal 31 abuts against the annular projection 1211 and seals the mounting hole; it can be understood that the radial dimensions of the seal 31 are larger than the inner diameter of the mounting hole so that the seal 31 can be stably abutted against the side of the annular projection 1211 facing the overflow port 1203 under the elastic force of the spring unit 322 and can seal the mounting hole, thereby preventing the liquid to be atomized from flowing out of the main unit 10 through the mounting hole and preventing the liquid to be atomized from dripping; specifically, the abutting protrusion 3211 is provided on the outer peripheral wall of the end of the top rod 321 facing away from the overflow port 1203, and the two ends of the spring unit 322 abut against the abutting protrusion 3211 and the annular projection 1211, respectively, thereby ensuring that the seal 31 can stably block the mounting hole and preventing the liquid to be atomized from dripping; of course, in other embodiments, the two ends of the spring unit 322 can also be respectively connected with the overflow tube 121 and the top rod 321 through bolts, welding, etc.; wherein, the spring unit 322 may be a spring.

In this embodiment, the trigger 21 is a push rod 211. The push rod 211 is used to push the top rod 321 to move within the mounting hole; it can be understood that after the main unit 10 is mounted on the water tank 20, when the push rod 211 pushes the top rod 321 towards the overflow port 1203 while compressing the spring unit 322, the seal 31 also moves with the top rod 321 towards the overflow port 1203 and the seal 31 is separated from the annular projection 1211. At this time, the excess liquid to be atomized enters the overflow tube 121 through the overflow port 1203 and then passes through the gap between the outer peripheral wall of the seal 31 and the inner peripheral wall of the overflow tube 121. Subsequently, it flows into the water tank 20 through the gap between the outer peripheral wall of the top rod 321 and the inner wall of the mounting hole so as to realize the recovery of the overflow of the excess liquid to be atomized, ensuring that the liquid to be atomized in the atomizing chamber 1201 is within the preset volume range and guaranteeing the normal atomization of main unit 10; after the main unit 10 is separated from the water tank 20, the spring unit 322 drives the top rod 321 to move away from the overflow port 1203 under the action of the force of elastic recovery and the seal 31 moves toward the annular projection 1211 along with the top rod 321; after the seal 31 abuts against the annular projection 1211, the seal 31 seals the mounting hole. At this time, the liquid to be atomized will not flow out from the mounting hole and will not drip onto objects such as the ground or table. The valve 30 adopts this elastic valve structure. The valve 30 opens and closes when the main unit 10 is detached from and mounted on the water tank 20. Its operation is simple. In addition, the use of this purely mechanical control method has good reliability and less risk of dripping of the liquid to be atomized.

In another embodiment of the present application, the seal 31 of the provided humidifier 100 is a silicone piece. The seal 31 is made of silicone material. The silicone material is soft, which can ensure that the seal 31 has a good sealing effect. In addition, silicone material has good reliability during use, which can improve the reliability and service life of the valve 30.

Figure 6:
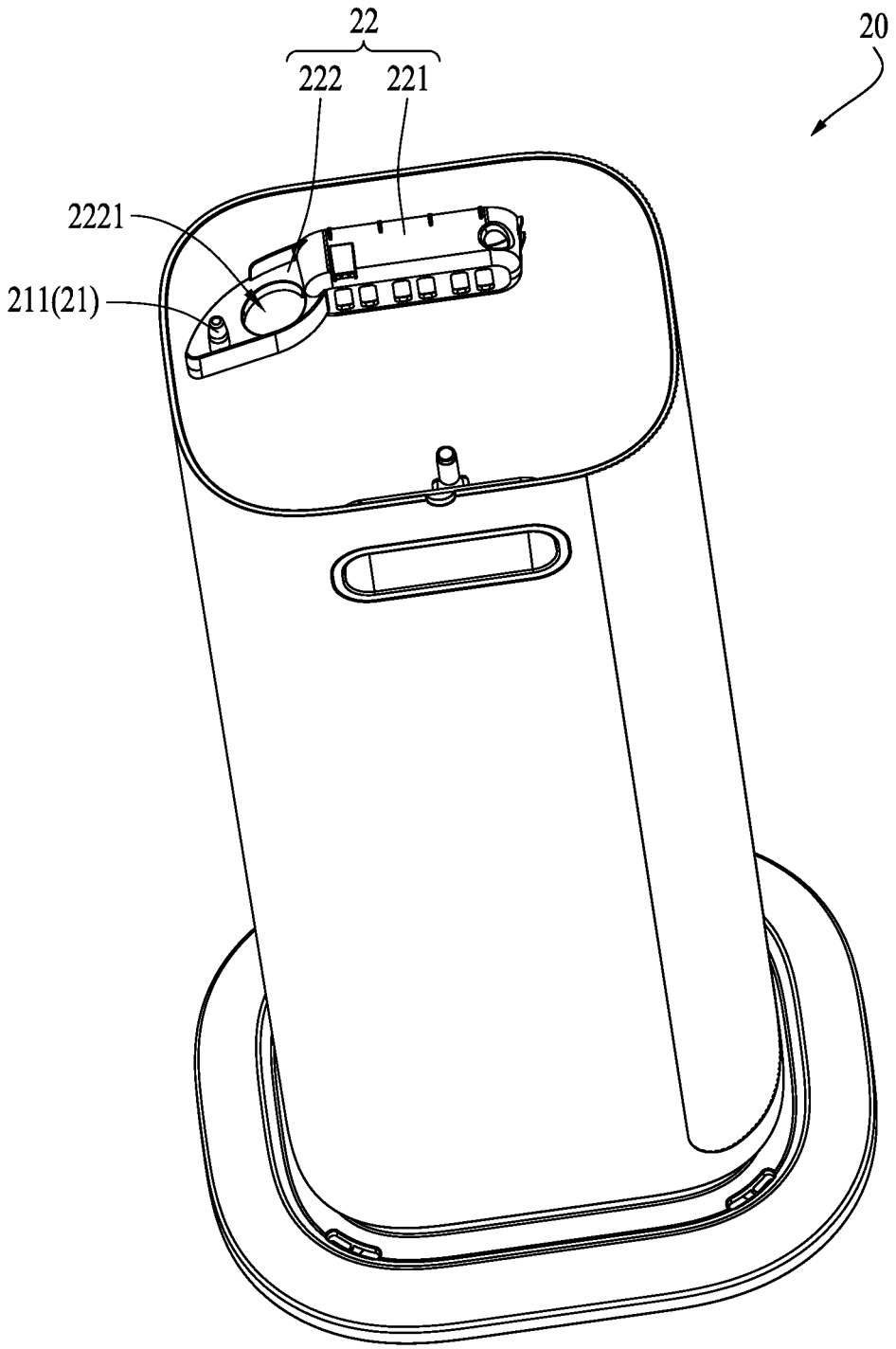
FIG. 6 is a schematic diagram of the structure of the water tank of the humidifier shown in FIG. 1.
Figure 7:
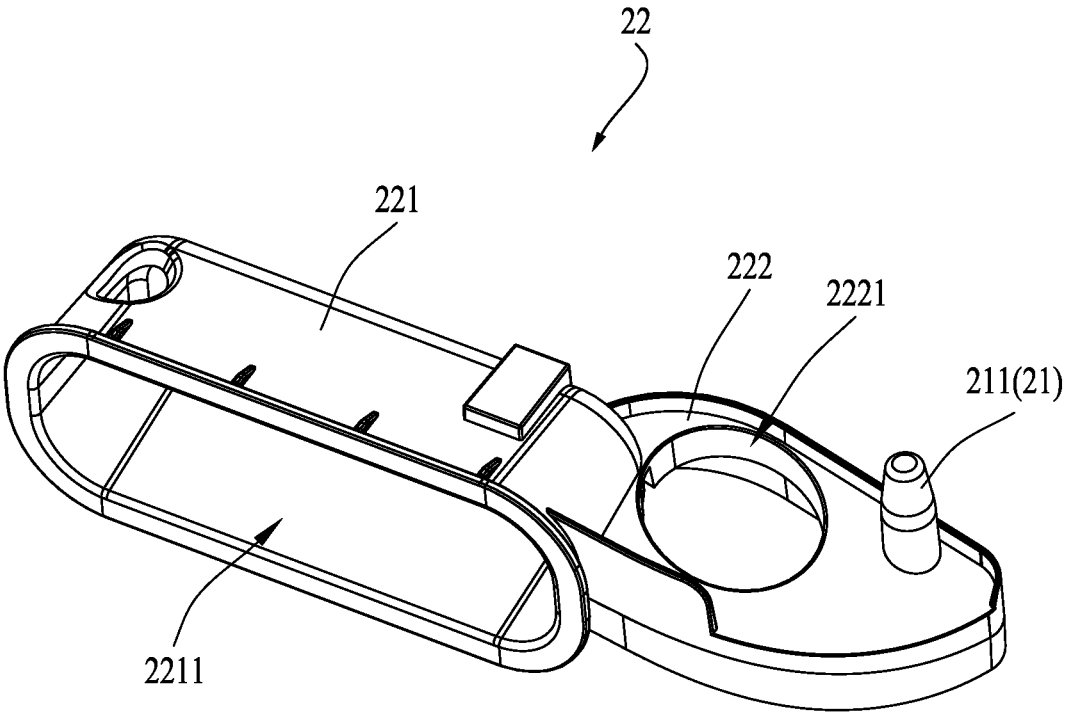
FIG. 7 is a schematic diagram of the structure of the handle of the tank shown in FIG. 6.

In another embodiment of the present application, with reference to FIGS. 6 and 7, a handle 22 is provided on the water tank 20 of the humidifier 100. The handle 22 is integrally formed with the trigger 21. It can be understood that the trigger 21 and the handle 22 are an integrated structure, which can reduce the number of parts and the production cost. In addition, the water tank 20 is provided with a handle 22, which also facilitates the movement of the humidifier 100. Wherein, the handle 22 and push rod 211 can be an integrated structure produced by integrated injection molding or 3D integrated molding.

In a specific embodiment, the push rod 211 and the handle 22 on the water tank 20 are an integrated structure, which can reduce the number of parts and assembly costs; specifically, the handle 22 and the push rod 211 can be made by integrated injection molding or 3D integrated molding.

In another embodiment of the present application, with reference to FIGS. 6 and 7, the handle 22 of the provided humidifier 100 is provided with a water drainage hole 2221 for water flow from the water filling opening 1202 into the water tank 20. Such arrangement prevents the liquid to be atomized flowing into the water filling opening 1202 from impacting the handle 22, preventing the liquid to be atomized from splashing. In a specific embodiment, the handle 22 comprises a connected operating portion 221 and a mounting portion 222. The operating portion 221 is mounted on the water tank 20. It can be understood that the operating portion 221 is exposed above the water tank 20, providing a spot to exert force for the user to facilitate the movement of the humidifier 100; specifically, the operating portion 221 is embedded in the handle hole. The operating portion 221 is recessed towards the internal depression of the water tank 20 to form a recessed space 2211, which can be extended by the user's hand to facilitate the movement of the humidifier 100 so that the operating portion 221 is not exposed outside the water tank 20, thereby reducing bumping and improving the safety of use.

In this embodiment, the mounting portion 222 is located in the water tank 20, the push rod 211 is provided on the mounting portion 222, and the mounting portion 222 is provided with a water drainage hole 2221 for the flow of water into the water tank 20 from the water filling opening 1202. In this way, when the water tank 20 is filled, the flow the liquid to be atomized from the water filling opening 1202 will not impact the mounting portion 222, preventing the liquid to be atomized from splashing. Specifically, the operating portion 221, the mounting portion 222, and the push rod 211 can be an integrated structure made using integrated annotation [sic: injection molding] or 3D integrated molding to create an integrated structure, providing savings on the production process and reducing the number of parts and the cost of assembly and production.

The above are only preferred embodiments of the application and are not intended to limit the present application. Any modifications, equivalent replacements, and improvements made within the spirit and principles of the application shall be included within the scope of protection of the present application.

For ease of reference, the reference numbers in the figure are:

| | | |
|---|---|---|
| 10-Main unit | 11-Mist outlet cover | 12-Outer housing |
| 13-Inner housing | 14-Top cover | 20-Water tank |
| 21-Trigger | 22-Handle | 30-Valve |
| 31-Seal | 32-Drive assembly | 100-Humidifier |
| 111-Mist outlet hole | 121-Overflow tube | 122-Rim |
| 123-Partition | 124-Connecting tube | 131-Mist outlet channel |
| 132-Water filling tube | 133-Water filling chamber | 141-Connecting hole |
| 211-Push rod | 221-Operating portion | 222-Mounting portion |
| 321-Top rod | 322-Spring unit | 1211-Annular projection |
| 1231-First convex platform | 1232-Second convex platform | 1201-Atomizing chamber |
| 1202-Water filling opening | 1203-Overflow port | 1024-Air outlet |
| 1205-Mounting chamber | 1221-Liquid inlet | 2211-Recessed space |
| 2221-Water drainage hole | 3211-Abutting protrusion | |

What is claimed is:

1. A humidifier comprising:

a water tank; and, a main unit that is detachably connected to the water tank;

wherein the main unit further comprises a valve and an atomizing chamber with a water filling opening and an overflow port in the atomizing chamber;

wherein both the overflow port and the water filling opening are in fluid communication with the water tank, with a rim in the atomizing chamber that surrounds the water filling opening;

wherein the valve is used to close the overflow port when the main unit is detached from the water tank.

2. The humidifier according to claim 1 wherein the atomizing chamber is further comprised of a chamber bottom surface with a first convex platform, the water filling opening and the overflow port are formed on the surface of the first convex platform on the chamber bottom surface of the atomizing chamber, and the rim is provided on the surface of the first convex platform separated from the chamber bottom surface of the atomizing chamber.

3. The humidifier according to claim 2 further comprising a second convex platform on the chamber bottom surface of the atomizing chamber and an air outlet formed on the end of the second convex platform and the rim is formed with a liquid inlet connected to the water filling opening, and the air outlet is located above the liquid inlet.

4. The humidifier according to claim 3 wherein the height difference between the liquid inlet and the air outlet is in a range between 5 mm-30 mm.

5. The humidifier according to claim 3 wherein the height difference between the liquid inlet and the overflow port is in a range between 30.4 mm-38.6 mm.

6. The humidifier according to claim 1, wherein the main unit comprises an outer housing and an inner housing, the atomizing chamber is formed within the outer housing, and the valve is set on the outer housing;

wherein the inner housing is located in the atomizing chamber, the inner housing is formed with a water filling chamber, and the inner housing is provided with a water filling tube where one end of the water filling tube is connected to the water filling chamber, while the other end of the water filling tube is inserted into the rim.

7. The humidifier according to claim 1 wherein a trigger is provided on the water tank for controlling the valve to close when the main unit is detached from the water tank.

8. The humidifier according to claim 7 wherein an overflow tube is formed within the main unit and one end of the overflow tube is connected to the overflow port; the valve is located at the other end of the overflow tube.

9. The humidifier according to claim 7, wherein the valve comprises a seal and a drive assembly and the trigger controls the drive assembly to move the seal to close the overflow tube when the main unit is detached from the water tank.

10. The humidifier according to claim 7, wherein a handle is provided on the water tank and handle is formed integrally with the trigger.

11. The humidifier according to claim 9, wherein a water drainage hole is provided on the handle for water flow into the water tank from the water filling opening.

12. The humidifier according to claim 11, wherein the handle further comprises an operating portion and a mounting portion located in the water tank and a push rod and the water drainage hole are provided on the mounting portion.

13. The humidifier according to claim 1, wherein when the main unit is detached from the water tank, the tilt angle of the main unit is between 0 and 25°.

14. A humidifier comprising:

a water tank; and, a main unit that is detachably connected to the water tank;

wherein the main unit further comprises a valve and an atomizing chamber with a water filling opening and an overflow port in the atomizing chamber;

wherein both the overflow port and the water filling opening are in fluid communication with the water tank, wherein the valve is used to close the overflow port when the main unit is detached from the water tank.

15. The humidifier according to claim 13, wherein the main unit comprises an outer housing, the atomizing chamber is formed within the outer housing, and the valve is set on the outer housing.

16. The humidifier according to claim 13, wherein a trigger is provided on the water tank.

17. The humidifier according to claim 15, wherein an overflow tube is formed within the main unit and one end of the overflow tube is connected to the overflow port; the valve is located at the other end of the overflow tube.

18. The humidifier according to claim 15, wherein a handle is provided on the water tank, and the handle being formed integrally with a trigger.

19. The humidifier according to claim 17, wherein a water drainage hole is provided on the handle.

* * * * *